US008952769B2

(12) United States Patent
Berry et al.

(10) Patent No.: US 8,952,769 B2
(45) Date of Patent: Feb. 10, 2015

(54) DUAL MODE DIELECTRIC RESONATOR OPERATING IN A HE MODE WITH A Q FACTOR NO LESS THAN 5000

(75) Inventors: Stephen D. Berry, San Ramon, CA (US); Stephen C. Holme, San Ramon, CA (US); Slawomir J. Fiedziuszko, Palo Alto, CA (US)

(73) Assignee: Space Systems/Loral, LLC, Palo Alto, CA (US)

( * ) Notice: Subject to any disclaimer, the term of this patent is extended or adjusted under 35 U.S.C. 154(b) by 460 days.

(21) Appl. No.: 13/247,243

(22) Filed: Sep. 28, 2011

(65) Prior Publication Data

US 2013/0076459 A1 Mar. 28, 2013

(51) Int. Cl.

| | |
|---|---|
| ***H01P 1/20*** | (2006.01) |
| ***H01P 1/208*** | (2006.01) |
| ***H01P 7/10*** | (2006.01) |
| ***H01P 11/00*** | (2006.01) |

(52) U.S. Cl.

CPC ..... *H01P 1/2084* (2013.01); *H01P 1/2086* (2013.01); *H01P 7/105* (2013.01); *H01P 11/008* (2013.01)

USPC ..... 333/202; 333/219.1

(58) Field of Classification Search

CPC ..... H01P 1/2084; H01P 1/2086; H01P 7/10; H01P 7/105; H01P 11/008

USPC ..... 333/202, 219.1

See application file for complete search history.

(56) References Cited

U.S. PATENT DOCUMENTS 4,489,293 A 12/1984 Fiedziuszko
6,297,715 B1 10/2001 Fiedziuszko et al.

OTHER PUBLICATIONS

Kobayashi et al; "Resonant Modes of a Dielectric Rod Resonator Short-Circuited at Both Ends by Parallel Conducting Plates"; IEEE Transaction for Microwave Theory and Techniques; vol. MTT-28, No. 10; Oct. 1980; pp. 1077-1085.*

Chen et al; "Properties of Dielectric Ring Resonator and Application to Moisture Measurement"; Subsurface Sensing Technologies and Applications; vol. 3, No. 3; Jul. 2002; pp. 203-216.*

Cohn, Seymour B. (Apr. 1968) "Microwave Bandpass Filters Containing High-Q Dielectric Resonators", IEEE Transactions on Microwave Theory and Techniques, vol. MTT-16, No. 4, 10 pages.

Fiedziuszko, S.J. (Sep. 1982) "Dual-Mode Dielectric Resonator Loaded Cavity Filters", IEEE Transactions on Microwave Theory and Techniques, vol. MTT-30, No. 9, 6 pages.

Fiedziuszko, S. Jerry, et al. (Mar. 2002) "Dielectric Materials, Devices, and Circuits", IEEE Transactions on Microwave Theory and Techniques, vol. 50, No. 3, 15 pages.

Kobayashi, Yoshio, et al. (Oct. 1980) "Resonant Modes of a Dielectric Rod Resonator Short-Circuited at Both Ends by Parallel Conducting Plates", IEEE Transactions on Microwave Theory and Techniques, vol. MTT-28, No. 10, 9 pages.

(Continued)

*Primary Examiner* — Benny Lee

(74) *Attorney, Agent, or Firm* — Weaver Austin Villeneuve & Sampson LLP

(57) ABSTRACT

A dual mode dielectric resonator (DR) filter has a first DR, and is configured to operate at a HE12δ mode within a first frequency band while exhibiting a Q factor of no less than 5000. A first characteristic size of the first DR may be substantially similar to a size of a second DR, where the second DR is configured to operate in a conventional DR filter at a HE11δ mode within a second frequency band, the second frequency band being substantially lower than the first frequency band.

15 Claims, 6 Drawing Sheets

(56) References Cited

OTHER PUBLICATIONS

Kobayashi, Yoshio, et al. (1981) "Resonant Modes for a Shielded Dielectric Rod Resonator", Denshi Tsushin Gakkai Ronbunshi, vol. 64B, No. 5, pp. 433-440, with English translation, 16 pages total.

Zaki, Kawthar A., et al. (Dec. 1983) "Modes in Dielectric-Loaded Waveguides and Resonators", IEEE Transactions on Microwave Theory and Techniques, vol. MTT-31, No. 12, 7 pages.

Zaki, Kawthar A., et al. (Jul. 1986) "New Results in Dielectric-Loaded Resonators" IEEE Transactions on Microwave Theory and Techniques, vol. MTT-34, No. 7, 10 pages.

* cited by examiner

FIG. 1 – PRIOR ART

DUAL MODE DIELECTRIC RESONATOR OPERATING IN A HE MODE WITH A Q FACTOR NO LESS THAN 5000

TECHNICAL FIELD

This invention relates generally to cavity filters, and particularly to a dual mode dielectric resonator loaded cavity filter operable at Ka-band.

BACKGROUND

The assignee of the present invention manufactures and deploys spacecraft for, inter alia, communications and broadcast services. Market demands for such spacecraft have imposed increasingly stringent requirements on spacecraft payloads. Particularly, there are increasing demands for more bandwidth and a consequential need to exploit higher frequency bands. With the advent of HD TV and other high data rate applications, for example, an increased demand for Ka-band (30 GHz uplink, 20 GHz downlink) satellite payloads has been observed.

Satellite communications payloads are typically channelized using narrow band filters to facilitate reamplification. The increase in total bandwidth combined with increased requirements for spatial frequency reuse with "spot" beam antennas results in a need for larger quantities of filters, and a corresponding pressure to decrease filter size, weight, and cost, while still providing a high "Q factor" and excellent temperature stability.

At frequencies below Ka-band, such as, for example, C and Ku-bands, dielectric resonator (DR) filter technology is commonly used. Such filters are described, for example in U.S. Pat. No. 6,297,715, assigned to the assignee of the present invention, and hereby incorporated into the present application in its entirety. Modifying known DR filters to operate at higher frequencies, however, would conventionally require reducing the size of critical components, such as the DR itself, tuning components, and the like. Consequently, Ka-band filters of the prior art generally employ air-filled cavity filters rather than DR filters so as to avoid the need to integrate extremely small resonators and ancillary components and suffer the consequential penalty in manufacturing cost, reliability, and/or filter performance. As a result, conventional Ka-band filters are disadvantageously large and heavy. Referring now to FIG. 1, for example, a comparison is provided of the respective sizes of a Ku-band DR filter 101 and a Ka-band air filled cavity filter 102.

SUMMARY OF THE INVENTION

The present inventors have discovered that an overmoded dual mode dielectric resonator loaded cavity filter, operable at a relatively high frequency such as Ka-band, can provide a comparable performance as air-filled cavity filters, while retaining substantial design commonality and size advantages of conventional Ku-band DR filters.

In an embodiment, a dual mode dielectric resonator (DR) filter includes a first DR, and the filter is configured to operate at a HE12δ mode within a first frequency band while exhibiting a quality factor (Q) of no less than 5000.

In a further embodiment, a first characteristic size of the first DR may be substantially similar to a size of a second DR, where the second DR is configured to operate in a conventional DR filter at a HE11δ mode within a second frequency band, and the second frequency band is substantially lower than the first frequency band. The filter may have a first external envelope dimension that is substantially identical to a second external envelope dimension of the conventional DR filter. The first frequency band may be within the Ka-band, and the second frequency may be within the Ku-band.

In another embodiment, Q is not less than 9000.

In an embodiment, a dual mode dielectric resonator (DR) filter, the filter comprising a first DR, is operated at a HE12δ mode within a first frequency band while exhibiting a quality factor (Q) of no less than 5000.

In another embodiment, a first characteristic size of the first DR is substantially similar to a size of a second DR, where the second DR is configured to operate in a conventional DR filter at a HE11δ mode within a second frequency band and the second frequency band is substantially lower than the first frequency band.

In an embodiment, a dual mode dielectric resonator (DR) filter includes a first DR. The filter is configured to operate at a higher order mode within a first frequency band while exhibiting a quality factor (Q) of no less than 5000. A first characteristic size of the first DR is substantially similar to a size of a second DR, where the second DR is configured to operate in a conventional DR filter at a lower order mode within a second frequency band, the second frequency band being substantially lower than the first frequency band.

In another embodiment, the higher order mode may be HE12δ and the lower order mode may be HE11δ.

BRIEF DESCRIPTION OF THE DRAWINGS

Features of the invention are more fully disclosed in the following detailed description of the preferred embodiments, reference being had to the accompanying drawings, in which.

Figure 1:
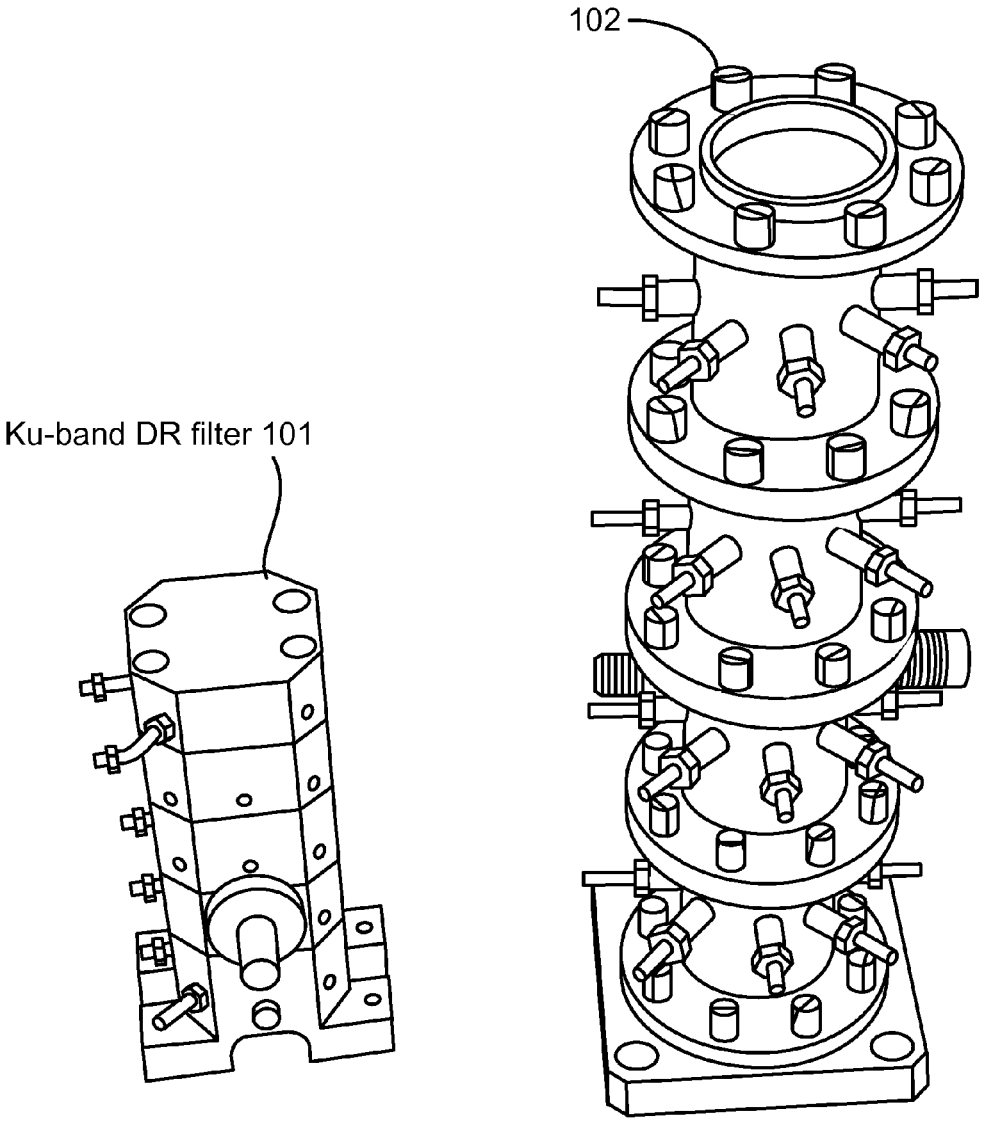
FIG. 1 illustrates a comparison between filters of the prior art.

Throughout the drawings, the same reference numerals and characters, unless otherwise stated, are used to denote like features, elements, components, or portions of the illustrated embodiments. Moreover, while the subject invention will now be described in detail with reference to the drawings, the description is done in connection with the illustrative embodiments. It is intended that changes and modifications can be made to the described embodiments without departing from the true scope and spirit of the subject invention as defined by the appended claims.

DETAILED DESCRIPTION OF THE INVENTION

Specific exemplary embodiments of the invention will now be described with reference to the accompanying drawings. This invention may, however, be embodied in many different forms, and should not be construed as limited to the embodiments set forth herein. Rather, these embodiments are provided so that this disclosure will be thorough and complete, and will fully convey the scope of the invention to those skilled in the art.

The terms "spacecraft", "satellite" and "vehicle" may be used interchangeably herein, and generally refer to any orbiting satellite or spacecraft system.

Most dielectric resonator ("DR") loaded cavity filters use either the TE01δ ("single mode") or HE11δ ("dual mode") resonance mode, as either may be dominant depending on the dimensions of the ceramic resonator. Such conventional DR filters, configured to operate at relatively low frequency bands such as C-band and Ku-band, are commonly used for, at least, space applications. Due to problems scaling such designs to the relatively high frequency Ka-band (for which the resonator and ancillary components, in the absence of the present teachings, would become quite small) DR filters have been avoided in favor of air-filled cavity filters.

The present inventors have discovered that an overmoded dual mode DR filter may be operable at a relatively high frequency such as Ka-band, while providing a similar or superior efficiency, manufacturability and reliability as compared to air-filled cavity filters. Advantageously, such a Ka-band DR filter may retain substantial design commonality with conventionally designed Ku-band DR filters, and exhibit similar size characteristics.

Figure 2:
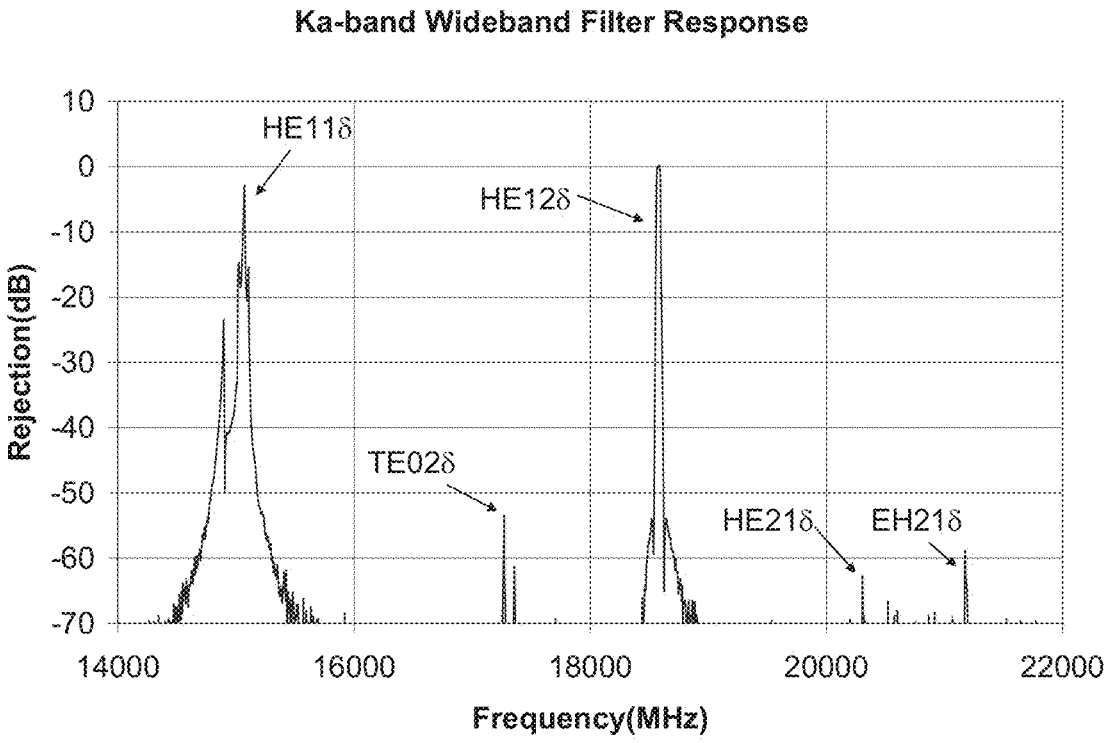
FIG. 2 identifies resonator modes and illustrates wide band rejection as a function of frequency for an embodiment.

More specifically, the present inventors observed, while testing conventionally sized and tuned dual mode Ku-band DR filters, that a well-formed filter rejection response naturally occurs about 2-3 GHz above the Ku-band. Analysis showed that this response results from the HE12δ mode of resonance, which also exhibits a dual mode response. By optimizing the dielectric resonator, more particularly by slightly reducing the radius and height of the resonator's ceramic disc, the characteristic frequency of the HE12δ mode was increased into the downlink Ka-band frequency range of 18-20 Ghz. In the results illustrated in FIG. 2, for example, rejection (dB) is plotted as a function of frequency (MHz) for a Ka-band wideband filter response in accordance with some implementations. A peak HE12δ mode resonance may be observed at a frequency of about 18700 MHz. For purposes of comparison, rejection as a function of frequency is also plotted for the HE11δ, TE02δ, HE21δ, and E H21δs modes, which exhibit mode resonances at about 1510 MHz, 1720 MHz, 2050 MHz, and 2120 MHz, respectively.

Figure 3:
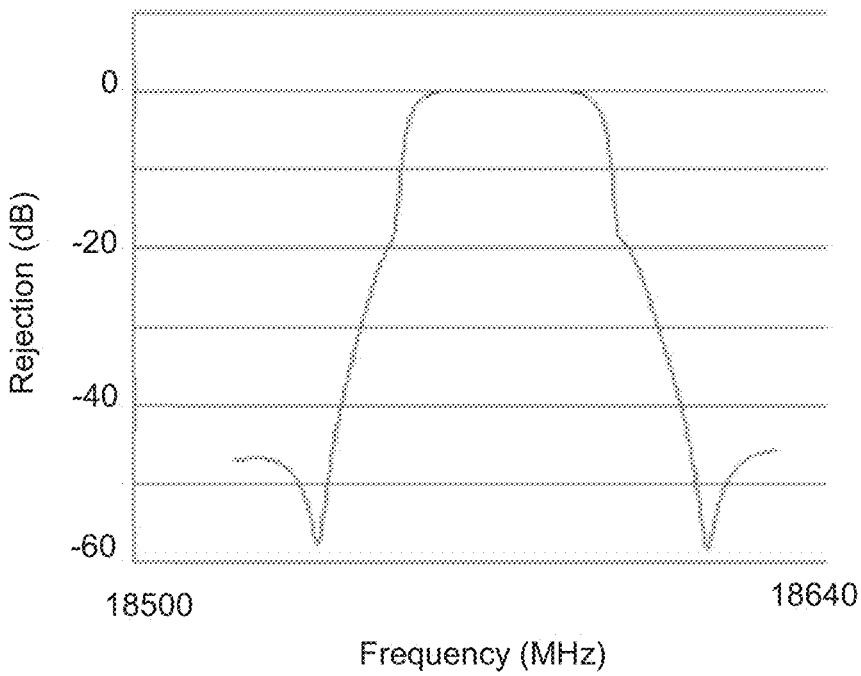
FIG. 3 illustrates rejection as a function of frequency for an embodiment.
Figure 4:
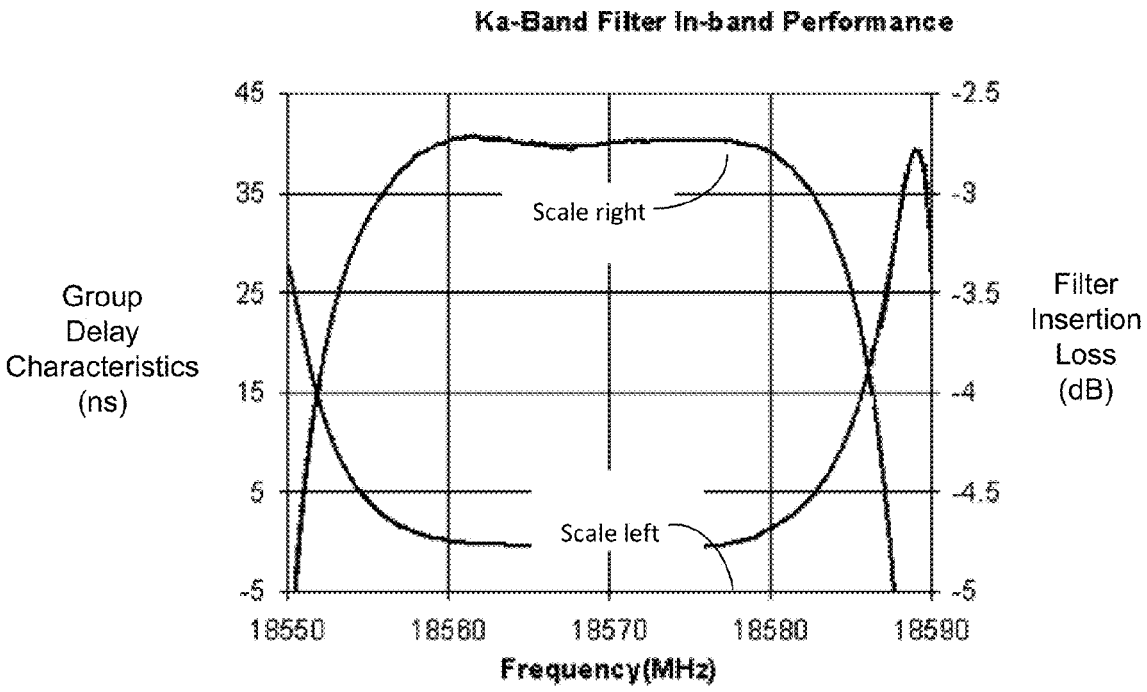
FIG. 4 illustrates delay and loss as a function of frequency for an embodiment.
Figure 5A:
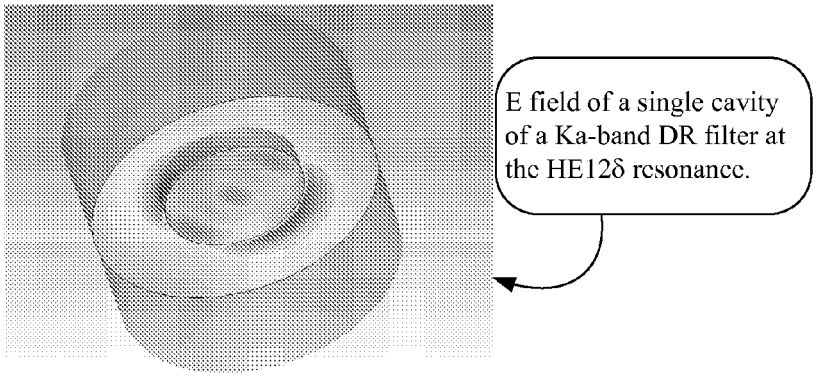
FIGS. 5*a* and 5*b* illustrate, respectively, E-field and H-field at a HE12δ resonance for an embodiment.
Figure 5B:
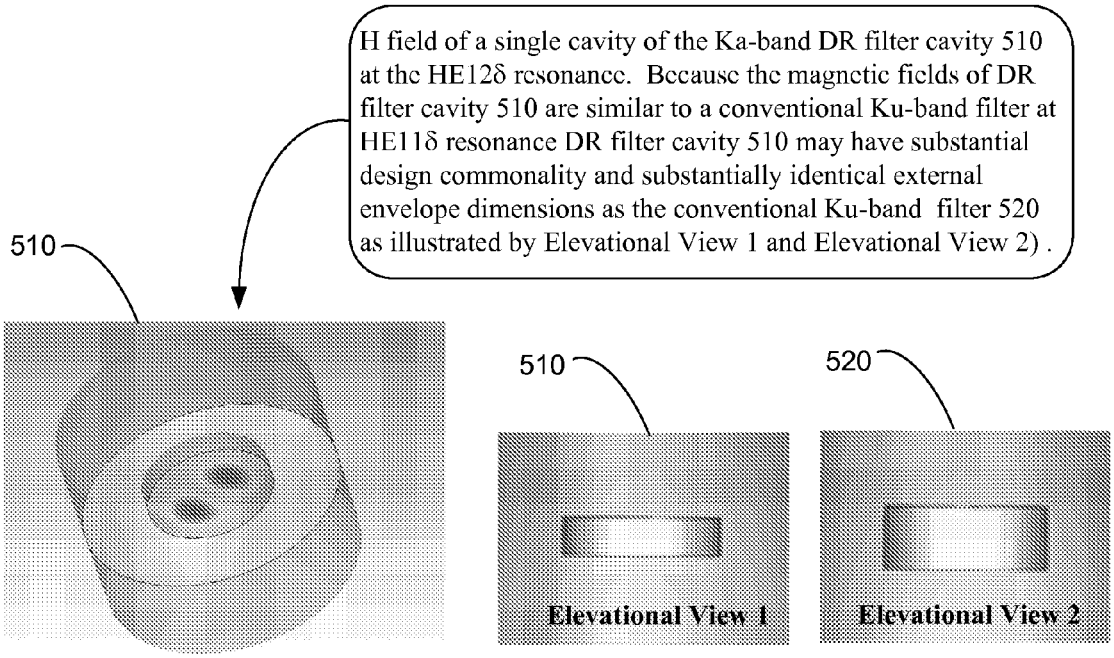

In an embodiment, an 8 pole DR filter constructed according to the present teachings yielded Ka-band filter rejection characteristics in dB versus Frequency in MHz as illustrated in the graph of FIG. 3. For the same device, the filter insertion loss in dB (i.e., scale right) and group delay characteristics in ns (i.e., scale left) are illustrated versus Frequency in MHz in the graph of FIG. 4. FIG. 5*a* and FIG. 5*b* show, respectively, the E and H fields of a single cavity at the HE12δ resonance. Because the magnetic fields of the embodiment illustrated in FIG. 5*b* at the HE12δ resonance are similar to the conventional Ku-band filter at HE11δ resonance, in some implementations, a Ka-band DR filter cavity 510 may be provided that has substantial design commonality and substantially identical external envelope dimensions as the conventional Ku-band DR filter cavity 520 (compare: Elevational View 1 and Elevational View 2). Advantageously, a DR filter designed and operated in accordance with the present teachings may be configured to operate over a wide range of frequencies within, at least, the Ka-band.

Figure 6:
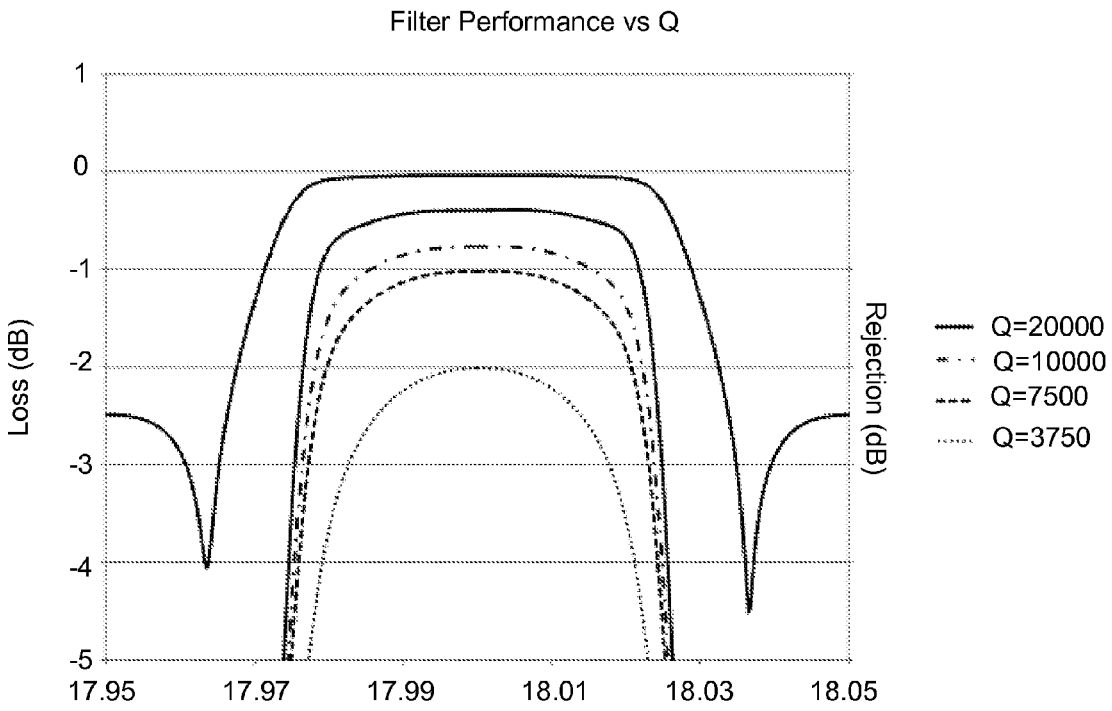
FIG. 6 illustrates unloaded Q factor impact on filter performance

An important figure of merit for assessing the performance or quality of a resonator is the unloaded quality factor, "Q" which is a ratio of energy loss or dissipation per RF cycle to the energy stored in the fields inside the resonator. That is, $Q=2\pi E_s/E_l$, where $E_s$ is the maximum energy stored during a RF cycle, and $E_l$ is the average energy dissipated per RF cycle. For a multiresonator filter, the Q factor determines (is inversely proportional to) insertion loss (and insertion loss variation) of the filter. Filter performance as a function of Q factor as measured by loss (in dB) and Rejection (in dB) versus Frequency (in GHz for Q values of 20000, 10000, 7500 and 3750 is illustrated in the graph of FIG. 6, for example.

The present inventors have found that a DR filter configured in accordance with the present teachings may exhibit a Q factor of at least 5000. In an embodiment, a Q factor of 9000 and higher has been demonstrated.

Thus, an overmoded dual mode dielectric resonator filter, operable at a relatively high frequency such as Ka-band, that provide a comparable Q factor as an air-filled cavity filter, while retaining substantial design commonality and size advantages of known Ku-band DR filters, has been disclosed.

The foregoing merely illustrates principles of the invention. It will thus be appreciated that those skilled in the art will be able to devise numerous systems and methods which, although not explicitly shown or described herein, embody said principles of the invention and are thus within the spirit and scope of the invention as defined by the following claims.

What is claimed is:

1. An apparatus, comprising:

a dual mode dielectric resonator (DR) filter, the filter comprising a first DR, wherein the DR filter exhibits a quality factor (Q) of no less than 5000 when operating at a HE12δ mode.

2. The apparatus of claim 1, wherein the DR filter exhibits a quality factor (Q) of no less than 5000 when operating at a HE12δ mode in a first frequency band, and the first DR has a first characteristic size that is substantially similar to a size of a second DR that is configured to operate in a conventional DR filter at a HE11δ mode within a second frequency band, the second frequency band being substantially lower than the first frequency band.

3. The apparatus of claim 2, wherein the DR filter has a first external envelope dimension that is substantially identical to a second external envelope dimension of the conventional DR filter.

4. The apparatus of claim 2, wherein the first frequency band is within the Ka-band, and the second frequency is within the Ku-band.

5. The apparatus of claim 1, wherein Q is not less than 9000.

6. A method, comprising operating a dual mode dielectric resonator (DR) filter, wherein the DR filter comprises a first DR and exhibits a quality factor (Q) of no less than 5000 when operating at a HE12δ mode.

7. The method of claim 6, wherein the DR filter exhibits the quality factor (Q) of no less than 5000 when operating at the HE12δ mode in a first frequency band, and the first DR has a first characteristic size that is substantially similar to a size of a second DR that is configured to operate in a conventional DR filter at a HE11δ mode within a second frequency band, the second frequency band being substantially lower than the first frequency band.

8. The method of claim 7, wherein the DR filter has a first external envelope with a volume that is substantially identical to a second external volume of the conventional DR filter.

9. The method of claim 7, wherein the first frequency band is within the Ka-band, and the second frequency is within the Ku-band.

10. The method of claim 6, wherein Q is not less than 9000.

11. A method, comprising:

operating a dual mode dielectric resonator (DR) filter, the DR filter comprising a first DR, operating at an HE12δ mode within a first frequency band while exhibiting a Q factor of no less than 5000, wherein a first characteristic size of the first DR is substantially similar to a size of a second DR, said second DR being configured to operate, in a conventional DR filter, at an HE11δ mode within a second frequency band, the second frequency band being substantially lower than the first frequency band.

12. A dual mode dielectric resonator (DR) filter comprising a first DR, wherein:

the DR filter is configured to operate at an HE12δ mode within a first frequency band while exhibiting a quality factor (Q) of no less than 5000; and a first characteristic size of the first DR is substantially similar to a size of a second DR, said second DR being configured to operate in a conventional DR filter at an HE11δ mode within a second frequency band, the second frequency band being substantially lower than the first frequency band.

13. The filter of claim 12, wherein Q is not less than 9000.

14. The filter of claim 12, wherein the first frequency band is within the Ka-band, and the second frequency is within the Ku-band.

15. The filter of claim 12, wherein the DR filter has a first external envelope with a volume that is substantially identical to a second external volume of the conventional DR filter.

* * * * *